United States Patent [19]

Lichtblau

[11] 4,260,990

[45] Apr. 7, 1981

[54] ASYMMETRICAL ANTENNAS FOR USE IN ELECTRONIC SECURITY SYSTEMS

[76] Inventor: George J. Lichtblau, 13 Tannery Hill Rd., Ridgefield, Conn. 06877

[21] Appl. No.: 92,325

[22] Filed: Nov. 8, 1979

[51] Int. Cl.[3] ..... G08B 13/24

[52] U.S. Cl. ..... 343/742; 340/572

[58] Field of Search ..... 340/572; 343/742, 788, 343/867

[56] References Cited

FOREIGN PATENT DOCUMENTS 2551348 5/1977 Fed. Rep. of Germany ..... 340/572

*Primary Examiner*—Eli Lieberman

*Attorney, Agent, or Firm*—Weingarten, Maxham & Schurgin

[57] ABSTRACT

An antenna system for use in an electronic security system and having a transmitting antenna with at least one loop lying in a plane, and a receiving antenna having at least two twisted loops lying in a common plane with each loop being twisted 180° and in phase opposition with each adjacent loop. The transmitting and receiving antennas are disposed in spaced substantially parallel relationship across an aisle or passage through which a resonant tag circuit must pass for detection.

7 Claims, 9 Drawing Figures

ASYMMETRICAL ANTENNAS FOR USE IN ELECTRONIC SECURITY SYSTEMS

FIELD OF THE INVENTION

This invention relates to electronic security systems and more particularly to antenna systems therefor.

BACKGROUND OF THE INVENTION

Electronic security systems are known for the detection of the unauthorized removal of items containing a resonant tag circuit. Such systems employ a transmitter providing an electromagnetic field in a zone or region under surveillance, and a receiver operative to detect a resonant tag frequency caused by the presence of a tag in the surveillance zone and to provide an output alarm indication of tag presence. A preferred electronic security system is described in U.S. Pat. No. 3,810,147, 3,863,244 and 3,967,161.

In electronic security such as those described in the above-cited patents, two identical planar single loop antennas are usually employed, one for transmitting and one for receiving. The transmitting loop antenna generates an electromagnetic field which extends far beyond the immediate area of the security system necessary for system operation. In addition, the receiving antenna is sensitive to external noise generated at great distances from the receiver relative to the small area of interest to system operation.

An antenna system is described in U.S. Pat. No. 4,016,553 in which the inherent problems of a simple loop antenna in an electronic security system are minimized by use of two or more identical parallel loop antennas connected in phase opposition or bucking relationship. The antenna system comprises a cluster of at least two parallel electrically conductive loops of similar size connected in phase opposition so that current always flows in mutually opposite directions through corresponding portions of each loop. As a result, the loops are magnetically arranged in a bucking relationship. The length of and spacing between the loops is small compared to the wavelength of the transmitted or received signals and is disclosed to be typically one tenth of the wavelength. The spacing between the parallel loops is an appreciable fraction, for example one fourth, of the width of the egress passage through which a detectable resonant circuit must pass in a security installation. A separate antenna cluster composed of phase opposed parallel loops can be connected to respective transmitter and receiver of the system, or a single antenna cluster can be employed with both the transmitter and receiver. At distances large compared to the dimensions of the transmitting antenna, the generated electromagnetic waves are cancelled by reason of the phaseopposed loop connection. At short distances between the receiving and transmitting antennas, the signals in adjacent parallel antenna conductors do not cancel, resulting in a net detectable signal. Electromagnetic waves incident on the receiving antenna from distances large compared to the antenna dimensions do not provide a sensible antenna signal, but electromagnetic waves incident upon the receiving antenna from sources close to the antenna are sensed to provide a electromagnetic waves incident receiving antenna signal.

Thus the antenna system described in U.S. Pat. No. 4,016,553 provides an electromagnetic field in an interrogation region while preventing high intensity fields from occuring outside of the interrogation region. This antenna system also provides detection of selected electromagnetic fields originating in the interrogation region from a resonant circuit while avoiding detection of fields originating from outside of the interrogation region.

The antenna system described in the aforesaid U.S. Pat. No. 4,016,553 suffers several disadvantages in practice. The bucking loop antennas must be separated by a significant distance relative to the distance between the transmitting antenna cluster and receiving antenna cluster. Moreover, the bucking loop antennas must be carefully aligned and balanced for optimum effect. The loops of an antenna cluster are typically spaced apart from each other by a distance corresponding to one fourth the distance across the egress passage. The size of the antenna cluster can become cumbersome for passage widths of conventiently large dimension. For example, for a passage width of six feet, the antenna cluster must be sufficiently large to accommodate a loop spacing of eighteen inches.

An improved antenna system for use with an electronic security system for the detection of resonant tag circuits is the subject of copending application Ser. No. 878,753, filed Feb. 17, 1978 of the same inventor as herein, and comprises a pair of substantially identical planar multiple loop antennas respectively connected to the transmitter and receiver of the security system and providing an electromagnetic field of high intensity in the interrogation region of the system while preventing high intensity fields at distances outside of the interrogation region which are large in comparison to the antenna dimensions. The antenna system also discriminates against interferring signals originating outside of the interrogation region at distances large compared with the antenna dimensions. Each planar antenna includes two or more loops lying in a common plane, with each loop being twisted 180° with respect to each adjacent loop to be in phase opposition. The transmitting antenna and receiving antenna are symmetrical, that is, identical or nearly so with respect to the number and size of the two or more loops, and are cooperative in that twisted loops of the receiving antenna reverse or decode the adjacent phase relationships of the twisted loops of the transmitting antenna. For each antenna, the total loop area of one phase is equal to the total loop area of opposite phase in order to achieve optimum performance. The antenna system is also effective to provide higher resonant tag detection sensititvity than conventional loop antennas.

SUMMARY OF THE INVENTION

In brief, the present invention provides an antenna system similar to that of the aforesaid copending application and wherein the two cooperating planar antennas are asymmetrical with respect to a each other to achieve certain performance benifits in the associated electronic security system. In one embodiment, the transmitting antenna is a single loop planar antenna, while the receiving antenna includes two or more loops lying in a common plane, with each loop twisted 180° with respect to each adjacent loop to be in phase opposition. Another embodiment comprises a transmitting antenna having two planar twisted loops, and a receiving antenna having three planar twisted loops, the loops of each antenna lying in a common plane with each loop being twisted 180° with respect to each adjacent loop.

To achieve optimum performance, the total loop area of one phase is equal to the total loop area of opposite phase. The asymmetrical system rejects noise generated at a distance large compared to the dimensions of the antenna, as with a system of the copending application. However, the single transmitting loop antenna is susceptible to noise generated at large distances. But, any deficit in noise suppression of the single loop antenna is offset by the improved tag detection sensitivity of the antenna system.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
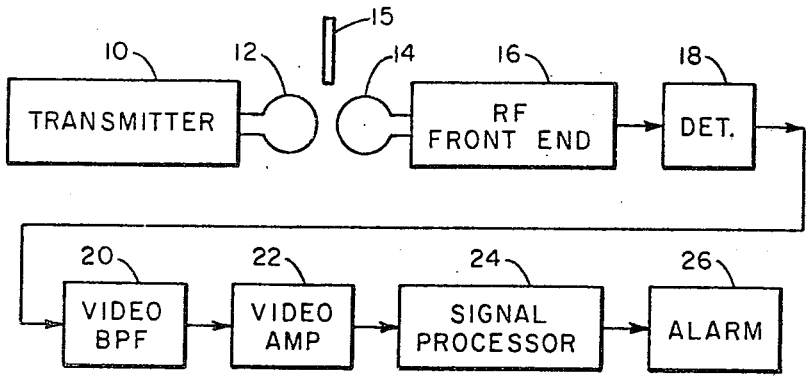
FIG. 1 is a block diagram of an electronic security system in which the invention is employed.

An electronic security system is shown in FIG. 1 and includes a transmitter 10 coupled to an antenna 12 operative to provide an electromagnetic field within a predetermined area to be controlled and which is repetitively swept over an intended frequency range. A receiving antenna 14 at the controlled area receives energy electromagnetically coupled from antenna 12 and is coupled to an RF front end 16 which includes an RF bandpass filter and RF amplifier. The output of the front end 16 is applied to a detector 18, and a video bandpass filter 20 the output of which is effective to pass only an intended frequency band and to remove carrier frequency components and high frequency noise. The output of filter 20 is applied to a video amplifier 22 and thence to signal processor 24, the output signal of which is applied to an alarm 26 or other output utilization apparatus to denote detection of a resonant tag 15 in the controlled area. The system illustrated in FIG. 1, is the subject of the above-identified U.S. Pat. Nos. 3,810,147, 3,863,244 and 3,967,161, and is operative to detect tag presence in a controlled area and to provide an alarm indication thereof. The signal processor 24 includes noise rejection circuitry operative to discriminate between actual tag signals and spurious signals which could be falsely detected as a tag and therefore cause a false alarm, as described in the aforesaid patents.

Figure 2:
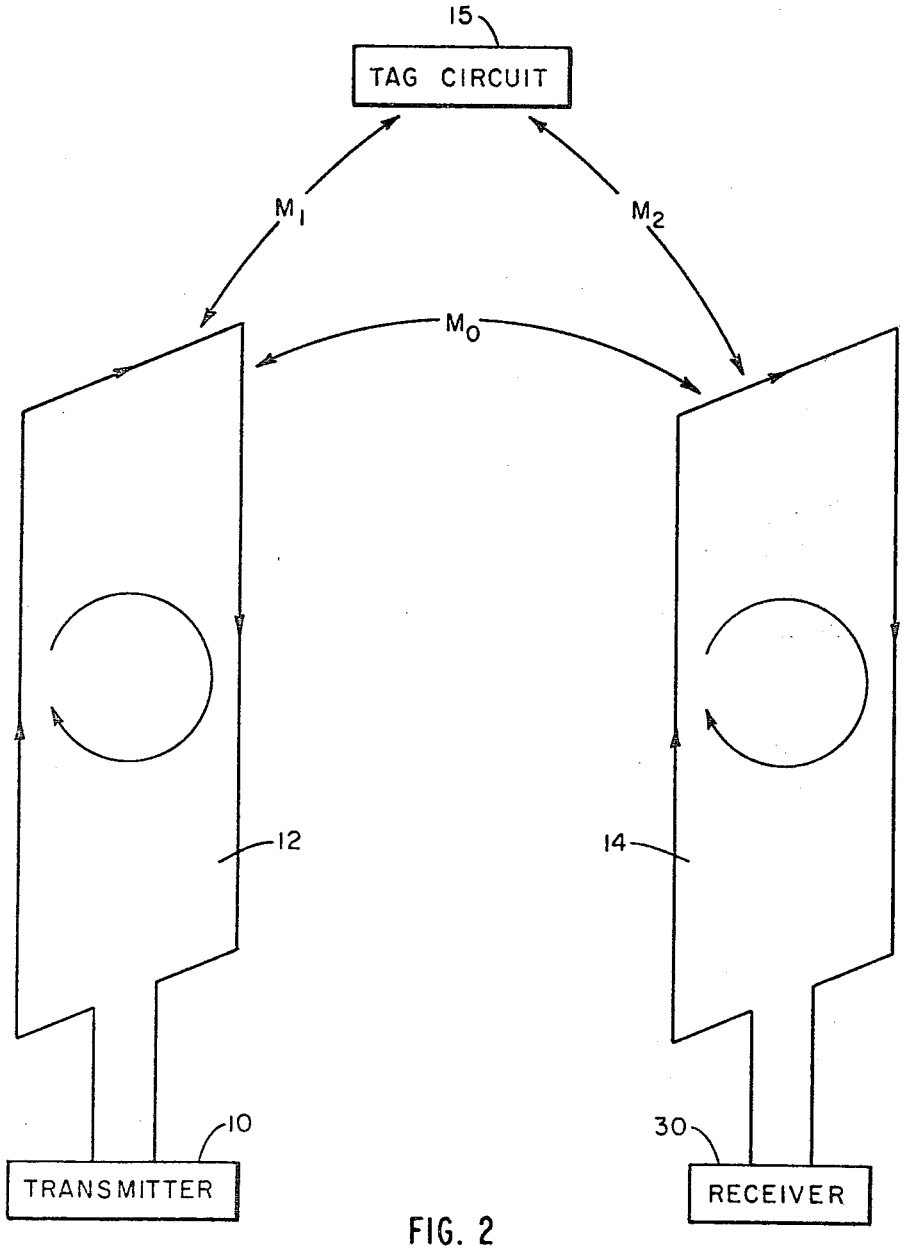
FIG. 2 PRIOR ART
FIG. 2 is a schematic diagram of prior art loop antennas employed in electronic security systems.

The antennas of the single loop type employed in the prior art are schematically illustrated in FIG. 2. The transmitting antenna 12 and receiving antenna 14 are each composed of a single rectangular loop of the same size and shape. The transmitting antenna 12 is connected to and energized by a transmitter 10, while the receiving antenna 14 is connected to a receiver 30 such as that depicted in FIG. 1. The respective antennas 12 and 14 are arranged on opposite sides of a passage or aisle and between which is the interrogation region through which items pass for detection of unauthorized removal. There is a relatively strong mutual magnetic coupling $M_o$ between the antennas 12 and 14. In the presence of a resonant tag circuit 15 in the interrogation region of the system, there is a magnetic coupling $M_1$ from the transmitting antenna 12 to the tag circuit 15, and a magnetic coupling $M_2$ from the tag circuit 15 to the receiving antenna 14. As the transmitted field is swept through the resonant frequency of tag circuit 15, the current induced in the resonant circuit varies as a function of frequency, in well-known manner. The resonant tag couples its induced current to receiving antenna 14 in addition to the signal coupled to the receiving antenna directly from the transmitting antenna 12. The resonant tag signal is then detected and processed in receiver 30 to discriminate a true tag signal from noise to provide an output signal to an alarm or other output utilization apparatus denoting detection of a resonant tag in the controlled area.

In a typical electronic security system installation, the loop antennas 12 and 14 are quite large, for example one foot wide by five feet high, and the transmitting antenna 12 creates relatively strong electromagnetic fields at distances large compared to the distances between the antennas. These deleterious characteristics of prior art loop antennas are eliminated or substantially minimized by the novel antenna systems to be presently described.

Figure 3:
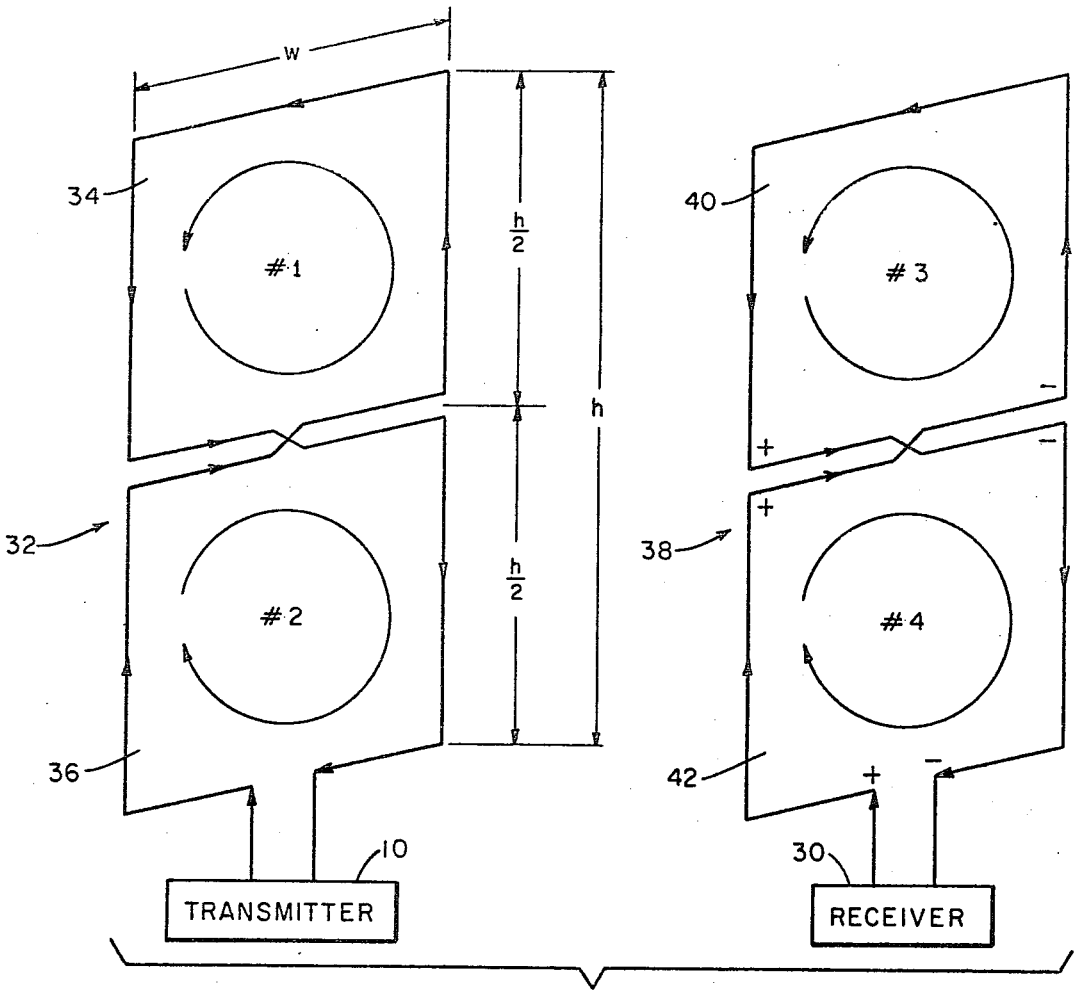
FIG. 3 is a schematic representation of one embodiment of a symmetrical antenna system.

Referring to FIG. 3 there is shown a transmitting antenna 32 lying in a single plane and twisted to form a symmetrical figure-eight pattern composed of an upper or first loop 34 and a lower or second loop 36. The antenna has a height h and a width w, each loop 34 and 36 having a height h/2. The receiving antenna 38 coupled to receiver 30 is identical to transmitting antenna 32 and is composed of a third loop 40 and a fourth loop 42. Each antenna 32 and 38 lies in a respective single plane and is of substantially identical configuration and dimensions with respect to the other antenna. Assuming that the dimensions of the antennas are small compared with the operating wavelength, there is little loss of energy due to radiation and the current through all branches of the figure-eight pattern is identical. In the transmitting antenna 32, the upper current loop (#1) is identical but in phase opposition to the lower current loop (#2). Thus, at distances from the transmitting antenna which are large relative to the dimensions of that antenna, the antenna appears as two equal current loops of precise opposite phase. As a result, at such large distances, the current loops effectively cancel each other.

Likewise, signals generated at large distances from the receiving antenna 38, couple almost equally to the upper loop (#3) and the lower loop (#4). Since the upper and lower loops of this antenna are twisted so as to "buck" each other (180° out of phase), signals which are coupled equally to both loops will cancel each other. Thus, the receiving loop antenna has a very low sensitivity to signals generated at large distances from that antenna. These properties of the figure-eight antenna are well known and documented in the literature.

Figure 6:
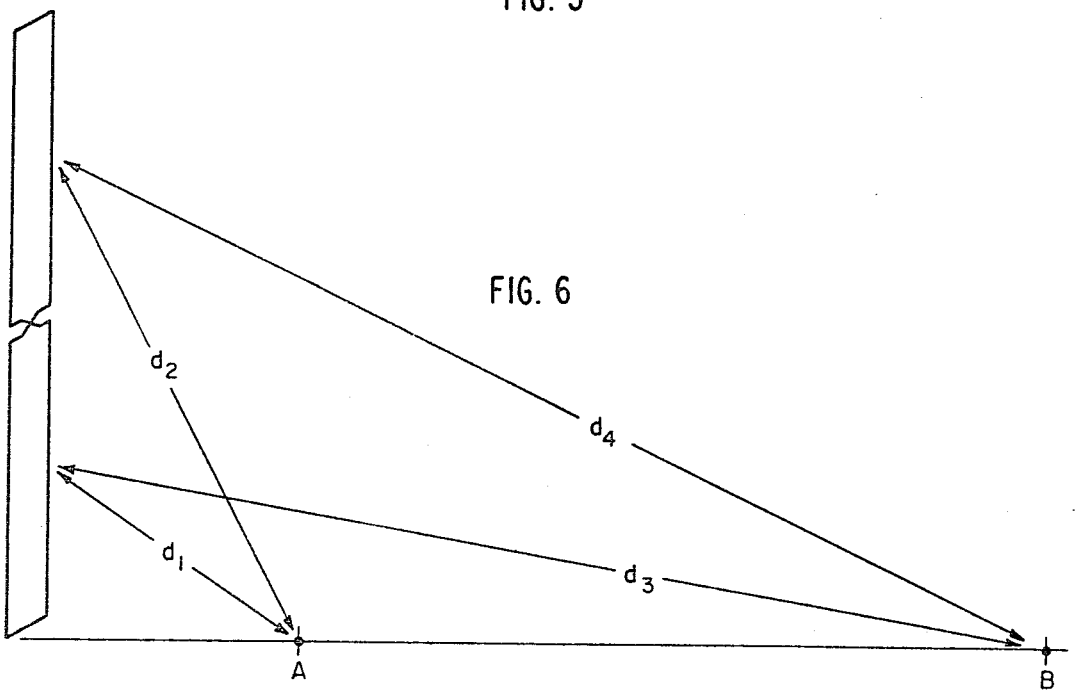
FIG. 6 is a diagramatic representation of antenna performance as a function of distance from the antenna.

FIG. 6 illustrates the typical case. Point B represents a point at a large distance from one of the antennas, for example ten times the antenna height. As a result, the distance $d_3$ from point B to the lower loop is essentially equal to the distance $d_4$ from point B to the upper loop. Thus, the equal and opposite signals generated by the upper and lower loops of the transmitter antenna cancel each other at point B. Likewise, any signal generated at point B is coupled almost equally to the upper and lower loops of the receiving antenna and thus cancel each other.

At distances close to the antenna, for example a distance equal to the height of the antenna, the cancellation effects are not very effective. For example, in FIG. 6 point A represents a point close to the antenna. Obviously, the distance $d_1$ from point A to the lower loop is much less than the distance$d_2$ from point A to the upper loop. Therefore, the signal from the lower loop will be much stronger at point A than the signal from the upper loop. Thus, there will be a net receiver signal at point A. The same holds true in reverse; i.e., any signal generated at point A will be stronger in the lower loop than the upper loop; thus, there will be a net signal from point A to the total antenna.

Figure 4:
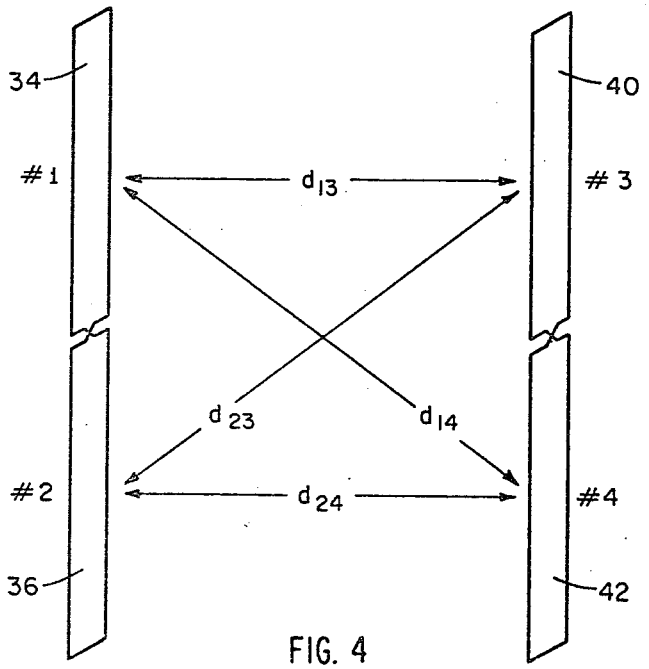
FIG. 4 is a diagramatic representation of the antenna coupling relationships of the embodiment of FIG. 3.

The receiving antenna 38 is disposed in a single plane which is parallel to the plane in which transmitting antenna 32 is disposed and in approximate alignment therewith. The figure-eight shape of the antenna 38 effectively reverses the phase of each of the opposing loops of the transmitting antenna 32 and results in a net signal to the receiver 30. The coupling relationships of the antennas 32 and 38 are depicted in FIG. 4. The transmitting loop 34 couples positively to receiving loop 40, while transmitting loop 36 couples positively to receiving loop 42. While the voltage induced in loop 40 is opposite to that induced in loop 42, by reason of the opposite sense of current flow in loops 34 and 36, since loop 42 is physically reversed 180° from loop 40, the net effect is to add in series the direct voltage induced in loops 40 and 42 from loops 34 and 36. In effect, the twist of the receiving antenna cancels the twist of the transmitting antenna. In addition to the direct coupling between the respective loops of the tranmitting antenna and the corresponding loops of the receiving antenna, loop 34 couples negatively to loop 42, while loop 36 couples negatively to loop 40. These cross coupled voltages in the receiving antenna also add to each other, and the sum of the cross coupled voltages subtracts from the sum of the direct coupled voltages. The net voltage $V_r$ at the receiver can be represented by the following equation $$V_r=(V_{13}+V_{24})-(V_{14}+V_{23})$$

where $V_{13}$ is the voltage induced by loop 1 (34) into loop 3 (40), $V_{24}$ is the voltage induced by loop 2 (36) into loop 4 (42), $V_{14}$ is the voltage induced by loop 1 into loop 4, and $V_{23}$ is the voltage induced by loop 2 into loop 3. Since the direct distance between loops, $d_{13}$ and $d_{24}$, is always less than the distance between cross coupled loops, $d_{14}$ and $d_{23}$, there is always a magnetic coupling from the transmitting antenna to the receiving antenna. Due to the cancellation effects of the cross coupling components between the transmitting and receiving antennas, it is desirable to provide more current in the figure-eight antenna than in a single turn antenna to obtain the same total voltage at the receiving antenna.

Figure 5:
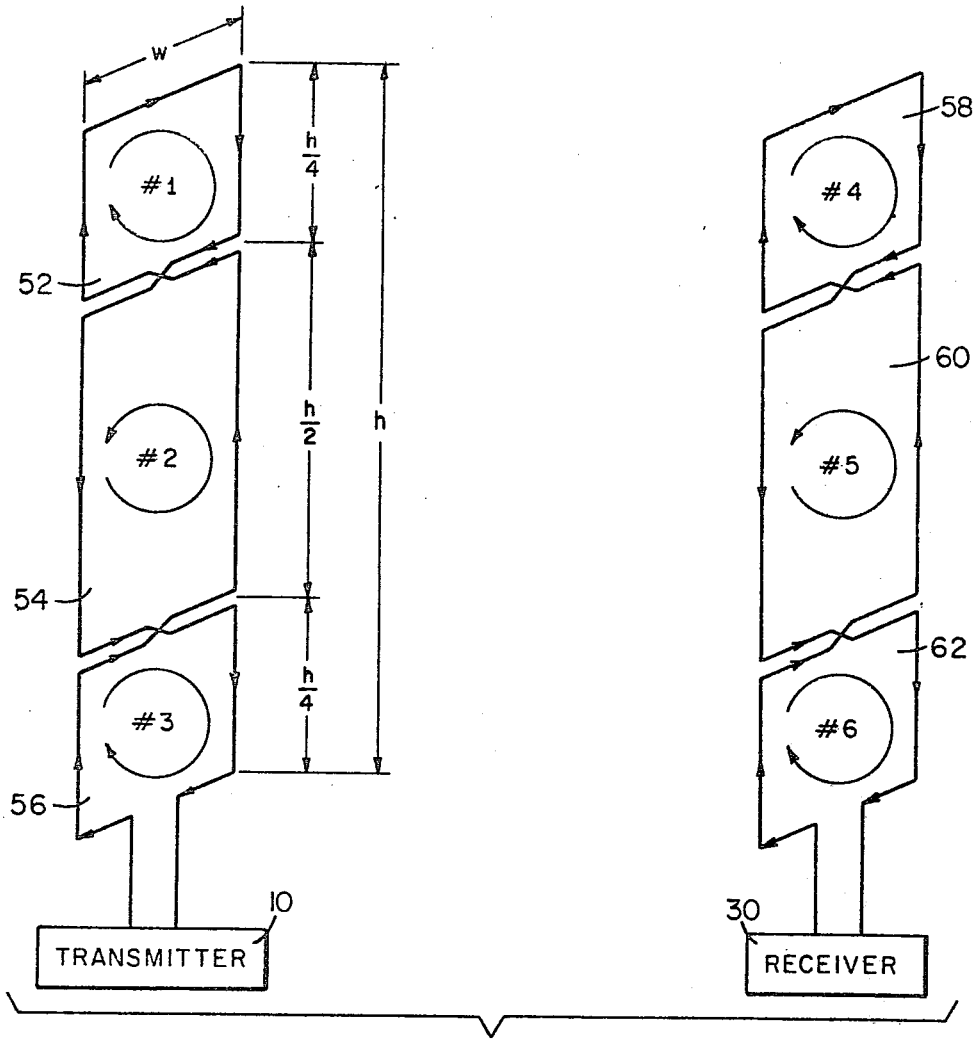
FIG. 5 is a schematic representation of another embodiment of a symmetrical antenna system.

The embodiment shown in FIG. 5 comprises a transmitting antenna coupled to transmitter 10 and having three generally rectangular twisted loops 52, 54 and 56 lying in a common plane, and a substantially identical receiving antenna coupled to a receiver 30 and having three twisted loops, 58, 60 and 62 lying in a common plane. Each antenna has a width w, and a total height h, with the center loops 54 and 60 having a height h/2, twice that of the outer loops 52, 56, 58 and 62. Thus, the outer loops 52 and 56 are each one-half the area of the center loop 54. Similarly, the outer loops 58 and 62 are each one-half the area of the center loop 60. For each antenna, each loop is twisted or opposite in phase to each adjacent loop. The outer loops are in phase with each other, and 180° out of phase with the center loop.

The net voltage $V_r$ at the receiver can be represented for the embodiment of FIG. 5 by the following equation $$V_r=(V_{14}+V_{25}+V_{36}+V_{16}+V_{34})-(V_{15}+V_{24}+V_{26}+V_{35})$$

where the notation of voltages is the same as described above. Thus, $V_{14}$ is the voltage induced by loop 1 into loop 4 etc. As in the embodiment of FIG. 3 there is always a net magnetic coupling from the transmitting antenna to the receiving antenna. At distances large compared to the antenna dimensions, the effects of loops 1 and 3 (52 and 56) cancel out the effects of loop 2 (54) and thus the electromagnetic field from the transmitting antenna drops rapidly with distance. In addition, the effects of external interference on the receiving antenna are negligible if they are generated at distances large compared to the antenna dimensions since the effects of loops 4 and 6 (58 and 62) cancel out the effects of loop 5 (60).

For optimum external cancellation, the sum of the total areas of all loops of each antenna phase opposing each other should have an algebraic sum of zero. That is, the total area of loops having one phase must be equal to the total area of loops having opposite phase. In some instances the transmitting and receiving antennas need not be identical but can be approximately so. For example, in the presence of a resonant tag circuit, the antennas become unbalanced, and it is sometimes desirable to slightly unbalance one antenna with respect to the other such as to adjust the detection band of the tag circuit.

The symmetrical antennas described above offer a further advantage over simple loop antennas, such as shown in FIG. 2; namely, the novel antenna system provides for induction of a greater signal into the receiving antenna in the presence of a resonant tag circuit. The signal induced into the receiving antenna is essentially the result of the signal directly coupled from the transmitting antenna to the receiving antenna in addition to the signal coupled from the transmitting antenna to the receiving antenna by way of the magnetically coupled resonant tag circuit. The ratio of the signal coupled by way of the resonant circuit compared to the directly coupled signal from the transmitting antenna to the receiving antenna is dependent upon the geometry of the antenna system and its coupling to the resonant tag circuit.

The area of the tag circuit is small compared to the area of any loop of the antennas, and in any typical detection position between the transmitting and receiving antennas, the tag circuit is preferentially coupled to one loop of the multiple loop receiving antenna. It is unlikely in practice to have the tag circuit at such a position to uniformly couple to all loops of the receiving antenna, and thus the tag couples to a greater extent to one loop of that antenna.

If the signal provided via the tag circuit remains constant, while the direct signal is reduced, there is an increase in the ratio of the tag signal compared to the direct signal, which implies an increase in detection sensitivity. With the present invention, for any given transmitter current level, the net signal coupled directly from the transmitting antenna to the receiving antenna is less than that with simple loop antennas by reason of the bucking effects of the cross coupled loops. The signal coupled to the receiving antenna by way of the tag circuit is, however, not reduced in the same proportion as the cross coupling effects of the transmitting and receiving antennas. The net result is that the signal from the tag circuit is increased relative to the directly coupled signal between the transmitting and receiving antennas when compared to the relationships of simple loop antennas of the prior art.

The symmetrical antennas thus described are the subject of the aforesaid copending application and provide reduced external fields from the transmitter, reduced noise in the receiver from external sources and inherently higher resonant tag detection sensitivity.

Figure 7:
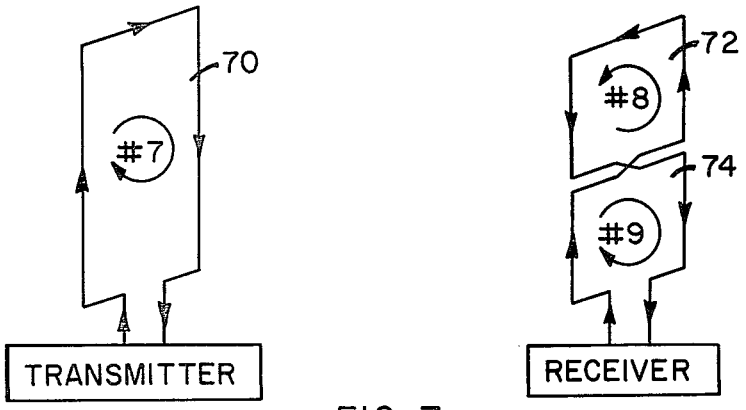
FIG. 7 is a schematic representation of one embodiment of an asymmetrical antenna system according to the invention.

The improvements of the present invention will be described in conjunction with FIGS. 7–9. Referring to FIG. 7, there is illustrated an asymmetrical planar antenna system having a single loop transmitting antenna and a two loop receiving antenna. These antennas are disposed in substantially parallel spaced relationship on respective opposite sides of an aisle or passage through which a tag circuit must pass for detection. The transmitting antenna includes a single loop 70, (#7), while the receiving antenna is a two loop planar antenna wherein the upper loop 72 (#8) is equal in area to the lower loop 74 (#9) and twisted to be 180° out of phase with the lower loop. The area of loop #7 is substantially the same as the total area of loops #8 and #9. If the receiving antenna is perfectly balanced and symmetrically placed with respect to the transmitting antenna, there is no net mutual magnetic coupling between the transmitting and receiving antennas. The signal coupled from loop #7 is coupled equally to loop #8 and loop #9, and since loops #8 and #9 are in a bucking relationship, there is no net signal produced at the output of the receiving antenna. In practice, the two loop antenna is intentionally unbalanced in order to provide some mutual coupling between the transmitting and receiving antennas, thereby to provide a carrier signal at the receiver to minimize internally and externally generated noise in the receiver. In effect, the antennas act as a balanced "bridge" in the detection zone between the antennas. If a resonant tag circuit is brought into this zone between the two antennas, the tag circuit will usually be preferentially coupled to either loop #8 or loop #9, which unbalances the bridge and induces a large resonant tag signal into the receiving antenna.

The two loop receiving antenna rejects most noise produced at distances large compared to the dimensions of the antenna. The one loop antenna is, however, susceptible to noise generated at a distance, and also generates relatively large electromagnetic fields at a distance. There is greater mutual magnetic coupling between the single loop transmitting antenna and the multiple loop receiving antenna than between the corresponding symmetrical multiple loop antennas. Therefore, a radio frequency carrier signal is coupled to the receiver which is of greater magnitude than the carrier level with the corresponding symmetrical loop antennas. As a result, a larger carrier signal-to-noise ratio and greater tag detection sensitivity is provided. Thus, the asymmetrical antenna set provides lower noise and a higher induced resonant tag signal in the receiver than the corresponding symmetrical antenna set, but at the expense of lesser noise suppression by the single loop transmitting antenna.

Figure 8:
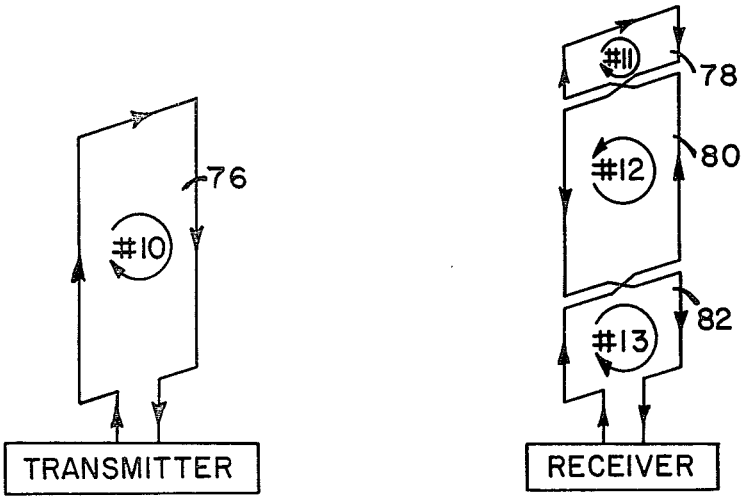
FIG. 8 is a schematic representation of an alternative embodiment of an asymmetrical antenna system according to the invention.

An alternative asymmetrical antenna system is shown in FIG. 8 wherein the transmitting antenna is a single loop planar antenna 76 #10), while the receiving antenna is a three loop balanced antenna composed of loops 78, 80 and 82 (#11,#12, and #13). The three loop antenna is identical to that illustrated in FIG. 5. The signal coupled from loop #10 to loop #12 is in bucking relationship to those signals coupled from loop #10 to loop #11 and to loop #13. However, there is always a net magnetic coupling from the single loop antenna to the three loop antenna, and the three loop antenna cannot form a precisely balanced bridge with the one loop antenna, since the upper (#11) and lower (#13) loops are offset from the center of loop #10. This assumes that the area of loop #11 and loop #13 are each exactly equal to one half the area of loop #12. The antenna system of FIG. 8 can be described as forming a partially balanced bridge. A resonant tag circuit introduced between the two antennas will usually couple preferentially to one of the three loops, which upsets the partial balance and generates a large tag signal in the receiver.

In comparison to the symmetrical antenna system of FIG. 5, the system of FIG. 8 has greater mutual magnetic coupling between the transmitting and receiving antennas, and a carrier signal induced by the transmitter into the receiver of greater magnitude. Thus, the carrier signal-to-noise ratio is higher than in the system of FIG. 5 and higher tag detection sensitivity is achieved.

While the transmitting antenna is susceptible to noise pickup in FIG. 8, this is not important in practice, since the transmitter input level is usually over 1,000 times greater than the receiver input level. Thus, the relative signal to noise pickup at the transmitter is of no importance compared to that of the receiver.

Figure 9:
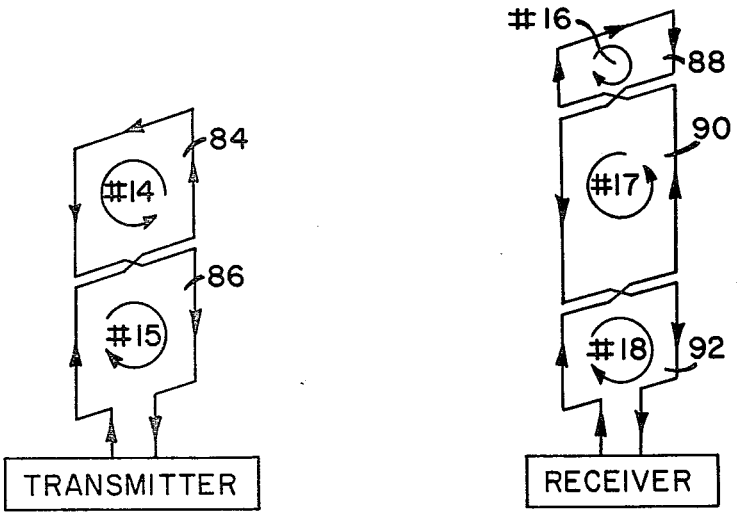
FIG. 9 is a schematic representation of a further embodiment of an asymmetrical antenna system according to the invention.

A further embodiment is shown in FIG. 9 wherein the transmitting antenna is a balanced two loop planar antenna having loops 84 and 96 (#14 and #15), and the receiving antenna is a balanced three loop planar antenna having loops 88, 90 and 92 (#16, #17 and #18). This embodiment provides a balanced bridge if the cooperating antennas are perfectly matched, and as a result tag detection sensitivity is very high. As in the embodiment of FIG. 7, this embodiment is in practice intentially unbalanced in order to provide carrier signal at the receiver which is helpful in reducing noise at the receiver. In performance, the embodiment of FIG. 9 is a compromise between the performance of the embodiments of FIG. 7 and FIG. 5. The FIG. 9 embodiment provides the balanced noise rejection and low radio frequency interference generation of the FIG. 5 embodiment, and provides higher tag detection sensitivity than the FIG. 5 embodiment.

Various modifications and alternative implementations will occur to those versed in the art without departing from the true scope of the invention. Accordingly, the invention is not to be limited except as indicated in the appended claims.

What is claimed is:

1. For use in an electronic security system having a transmitter for providing in a surveillnance zone an electromagnetic field of a frequency which is repetitively swept over a predetermined frequency range, a resonant tag of resonant frequency within the swept range and a receiver for detecting the presence of the resonant tag in the surveillance zone and to provide an alarm indication thereof, an antenna system comprising:

a transmitting antenna adapted for coupling to said transmitter and having at least one loop lying in a plane;

a receiving antenna adapted for coupling to said receiver and having at least two twisted loops lying in a common plane, each loop being twisted 180° and in phase opposition with each adjacent loop;

said antennas having a different number of loops and a mutual magnetic coupling therebetween and said receiving antenna having an effective total loop area of one phase equal to the effective total loop area of opposite phase;

said transmitting antenna and said receiving antenna being disposed in spaced substantially parallel relationship on respective opposite sides of a passage through which said tag must pass for detection.

2. The antenna system of claim 1 wherein the loops of one antenna are substantially in alignment with the corresponding loops of the other antenna.

3. The antenna system of claim 1 wherein the receiving antenna has three twisted loops lying in a common plane, each loop being twisted 180° and in phase opposition with each adjacent loop.

4. The antenna system of claim 3 wherein the receiving antenna has a center loop of area twice that of each outer loop.

5. The antenna system of claim 1 wherein the loops of each antenna are generally rectangular.

6. For use in an electronic security system having a transmitter for providing in a surveillance zone an electomagnetic field of a frequency which is repetitively swept over a predetermined frequency range, a resonant tag of resonant frequency within the swept range and a receiver for detecting the presence of the resonant tag in the surveillance zone and to provide an alarm indication thereof, an antenna system comprising;

a transmitting antenna adapted for coupling to said transmitter and having two twisted loops lying in a common plane, each loop being in phase opposition with each adjacent loop;

a receiving antenna adapted for coupling to said receiver and having three twisted loops lying in a common plane each loop being in phase opposition with each adjacent loop;

each antenna having an effective total loop area of one phase equal to the effective total loop area of opposite phase.

7. An antenna system for use in an electronic security system for detection of unauthorized removal of items containing a resonant tag circuit, said antenna system comprising:

a transmitting antenna coupled to the security system transmitter and a receiving antenna coupled to the security system receiver, said antennas being disposed in spaced parallel relationship and between which said items must pass for detection;

the transmitting antenna having two coplanar loops lying successively along an antenna axis, each loop being twisted 180° with respect to the adjacent loop to be in phase opposition;

the receiving antenna having three coplanar loops lying successively along an antenna axis, each loop being twisted 180° with respect to each adjacent loop to be in phase opposition; the center loop being of one phase and the outer loops each being of opposite phase to that of the center loop;

each antenna having an effective total loop area of one phase equal to the effective total loop area of opposite phase.

* * * * *

UNITED STATES PATENT AND TRADEMARK OFFICE

CERTIFICATE OF CORRECTION

PATENT NO. : 4,260,990

DATED : April 7, 1981

INVENTOR(S) : George J. Lichtblau

It is certified that error appears in the above-identified patent and that said Letters Patent are hereby corrected as shown below:

Column 1, line 18, "No." should read --Nos.--;
line 55, "phaseopposed" should read --phase opposed--;
line 64, "electromagnetic waves incident receiving antenna sig-" should read --receiving antenna sig- --;

Column 2, line 18, "conventiently" should read --conveniently--;
line 58, "benifits" should read --benefits--;

Column 5, line 43, "tranmitting" should read --transmitting--;

Column 8, line 12, "76 #10)," should read --76 (#10),--;

Column 9, line 2, "surveillnance" should read --surveillance--.

Signed and Sealed this

*Eighteenth* Day of *August 1981*

[SEAL]

*Attest:*

GERALD J. MOSSINGHOFF

*Attesting Officer*

*Commissioner of Patents and Trademarks*